US007073484B2

(12) United States Patent
Sako

(10) Patent No.: US 7,073,484 B2
(45) Date of Patent: Jul. 11, 2006

(54) INTERNAL COMBUSTION ENGINE CONTROL APPARATUS

(75) Inventor: Hitoshi Sako, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/109,797

(22) Filed: Apr. 20, 2005

(65) Prior Publication Data

US 2006/0086339 A1 Apr. 27, 2006

(30) Foreign Application Priority Data

Oct. 27, 2004 (JP) ..... 2004-312424

(51) Int. Cl.
*F02D 41/08* (2006.01)

(52) U.S. Cl. ..... 123/339.23; 123/339.1

(58) Field of Classification Search ..... 123/339.23, 123/339.15, 339.1, 585, 586
See application file for complete search history.

(56) References Cited

U.S. PATENT DOCUMENTS 4,378,767 A * 4/1983 Kobashi et al. ..... 123/339.26
4,392,468 A * 7/1983 Kobashi et al. ..... 477/111
4,401,073 A * 8/1983 Furuhashi ..... 123/320
4,484,553 A * 11/1984 Kobayashi et al. .... 123/339.15
5,056,483 A * 10/1991 Ohuchi ..... 123/339.15
5,586,534 A * 12/1996 Fujimoto ..... 123/325
5,623,903 A * 4/1997 Ueda ..... 123/339.23
5,701,867 A * 12/1997 Mizutani et al. ..... 123/339.16
6,725,831 B1 * 4/2004 Asano et al. ..... 123/339.23

FOREIGN PATENT DOCUMENTS

JP 5-106481 A 4/1993

* cited by examiner

*Primary Examiner*—Mahmoud Gimie
(74) *Attorney, Agent, or Firm*—Sughrue Mion, PLLC

(57) ABSTRACT

An engine control apparatus includes: an operation state determining unit determining whether the engine is in the running or the idle-state from a various sensor's signal; an engine revolution speed detecting unit detecting the revolution speed of the engine from a signal of an external sensor; a running time control value setting unit which sets an open/close control value for an ISC valve to be increased during the running-state such that the valve opens as the engine revolution speed is increased; and idle time control value setting units to which set the open/close control value such that the engine reaches a preset target revolution speed during the idle-state, and provide a lower limit value to the open/close control value during a predetermined period after the engine is switched from the running to the idle-state and set the control value not to be smaller than the lower limit value.

5 Claims, 8 Drawing Sheets

INTERNAL COMBUSTION ENGINE CONTROL APPARATUS

BACKGROUND OF THE INVENTION

1. Field of the Invention

The present invention relates to an internal combustion engine control apparatus, and more particularly to open/close control of an idle speed control valve provided in a bypass pipe provided secondarily to an air inlet pipe for supplying air to an engine.

2. Description of the Related Art

Heretofore, in an internal combustion engine control apparatus for use in an automotive engine and the like, a bypass pipe having an idle speed control valve (hereinafter referred to as an ISC valve) provided therein has been provided secondarily to an air inlet pipe in order to maintain revolution speed (r.p.m.) of the engine in an idle state at a constant low revolution speed. When the engine is in the idle state, the air inlet pipe is totally closed by a throttle valve provided therein. Accordingly, the ISC valve is controlled by closed loop (feedback) control, and thus a quantity of air passing through the bypass pipe is finely adjusted.

In this type of the internal combustion engine control apparatus, especially in the case where the engine is switched from a running state of revolving at high speed to the idle state, when the ISC valve of the bypass pipe is abruptly closed simultaneously when the throttle valve of the air inlet pipe is totally closed, an air/fuel (A/F) ratio turns to a state where fuel is excessive (over-rich) owing to abrupt falling down of the quantity of air supplied to the engine. Such an over-rich state causes misfire, resulting in lowering of the revolution speed of the engine, or in an engine stop. In this connection, there is known an apparatus which performs control to maintain the quantity of air passing through the bypass pipe until the revolution speed (number of revolutions) of the engine is lowered to a predetermined value in the case where the engine is switched from the running state to the idle state (for example, refer to JP 05-106481 A).

As described above, in this type of internal combustion engine control apparatus, in the case where the engine is switched from the running state to the idle state, the ISC valve of the bypass pipe is abruptly closed simultaneously when the throttle valve of the air inlet pipe is totally closed. Accordingly, the quantity of air supplied to the engine abruptly falls down, which causes the misfire. Thus, the revolution speed of the engine is lowered, or the engine stops. Such a problem has been inherent in this type of internal combustion engine control apparatus.

SUMMARY OF THE INVENTION

The present invention has been made in order to solve the above-described problem. It is an object of the present invention to provide an internal combustion engine control apparatus, in which, unlike the apparatus as disclosed above, a closing amount of the ISC valve is limited by providing a lower limit value thereto during a predetermined period of time after the engine is switched from the running state to the idle state, thereby preventing the lowering of the revolution speed of the engine and the engine stop.

According to the present invention, there is provided an internal combustion engine control apparatus that performs open/close control of an ISC valve provided in a bypass pipe to adjust a quantity of air passing through the bypass pipe, the bypass pipe being provided secondarily to an air intake pipe for supplying air to an engine so as to connect portions before and behind a throttle valve, the apparatus including: operation state determining means for determining whether the engine is in a running state or an idle state according to a signal from an external sensor; engine revolution speed detecting means for detecting revolution speed of the engine according to a signal from an external sensor; a running time control value setting unit which sets an open/close control value for the ISC valve such that the control valve increases and the valve opens as the revolution speed of the engine increases, while the engine is in the running state; and an idle time control value setting unit which sets the open/close control value for the ISC valve such that the engine reaches a preset target revolution speed while the engine is in the idle state, and provides a lower limit value to the open/close control value during a predetermined period of time after the engine is switched from the running state to the idle state and sets the control value not to be smaller than the lower limit value.

According to the present invention, even when the throttle is rapidly closed at the time when the engine runs, that is, when the revolution speed of the engine is high, thereby shifting the state of the engine to the idle state, an intake flow can be prevented from radically falling by providing the lower limit value to the control value for the ISC valve during the predetermined period of time. Thus, the A/F does not turn to the over-rich state, and accordingly, abnormal lowering of the revolution speed of the engine can be prevented.

DETAILED DESCRIPTION OF THE PREFERRED EMBODIMENT

An embodiment of the present invention will be described below by showing one cylinder representatively. However, as well known, actually, some engines have a plurality of cylinders, and in such engines, similar control is performed for each of the cylinders.

Figure 1:
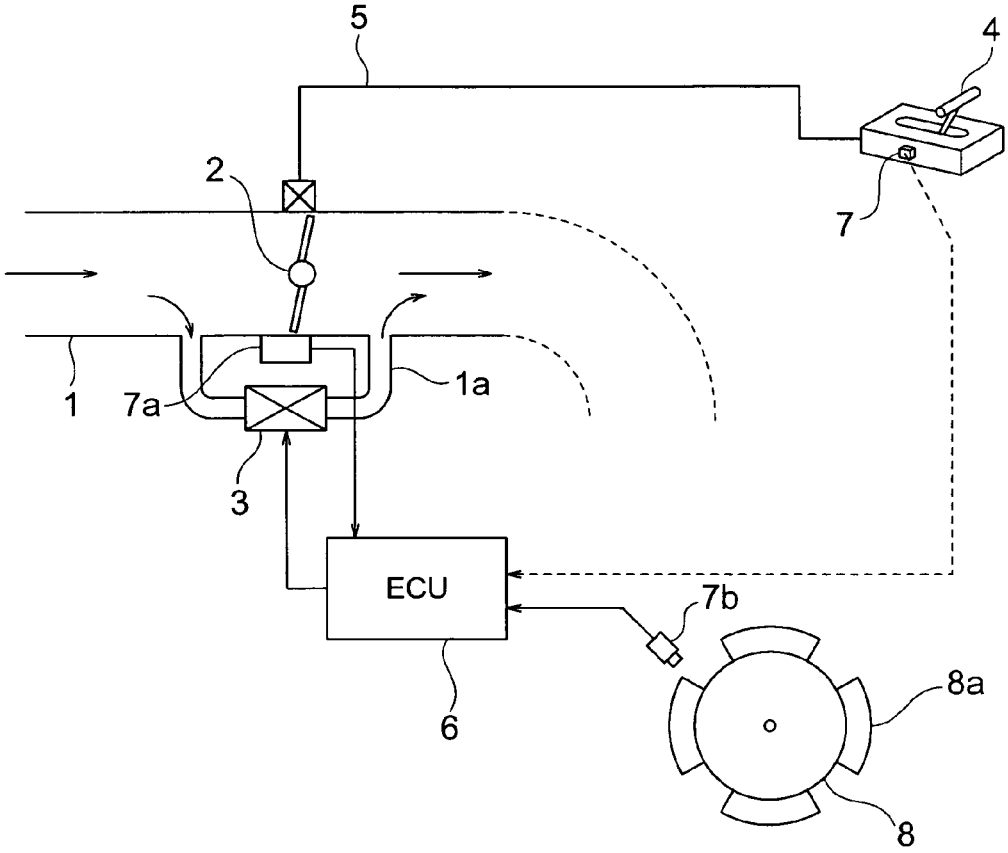
FIG. 1 is a schematic view showing a configuration of an internal combustion engine control apparatus according to an embodiment of the present invention.

FIG. 1 is a schematic view showing a configuration of an internal combustion engine control apparatus according to an embodiment of the present invention. In FIG. 1, an air intake pipe 1 is one for supplying air from the outside in order to generate an air/fuel mixture in a cylinder (not shown) of an engine, and a quantity of air passing through the air intake pipe 1 is adjusted by a throttle valve 2. To portions of the air intake pipe 1, which are placed before and behind a position where the throttle valve 2 is provided, a bypass pipe 1*a* is provided secondarily so as to connect the portions before and behind the position where the throttle valve 2 is provided to each other in order to adjust a quantity of intake air at an idle time. A quantity of air passing through the bypass pipe 1*a* is adjusted by an ISC valve 3. An opening angle of the throttle valve 2 is adjusted through a throttle wire 5 according to, for example, an operation of a throttle lever 4 operated by a driver. A throttle position detection sensor 7 is one which detects an operative position of the throttle lever 4, and provided for obtaining the throttle opening angle (and eventually, an operation state D indicating whether the engine is in a running state or an idle state). Note that, in place of the throttle position detection sensor 7, a throttle valve opening angle sensor 7*a* which detects the opening angle of the throttle valve 2 (totally closed in the idle state) may be provided, and the throttle opening angle may be obtained therefrom. A crank angle sensor 7*b* is one provided for obtaining revolution speed of the engine from a crank signal plate 8*a* attached onto a crankshaft 8. Moreover, an electronic control unit (ECU) 6 performs control of the whole of the internal combustion engine, including control of the ISC valve 3 based on the operation state of the engine and the revolution speed thereof according to the present invention. Note that the operation state of the engine can also be obtained from the revolution speed of the engine, which is obtained from the crank angle sensor 7*b*.

Figure 2:
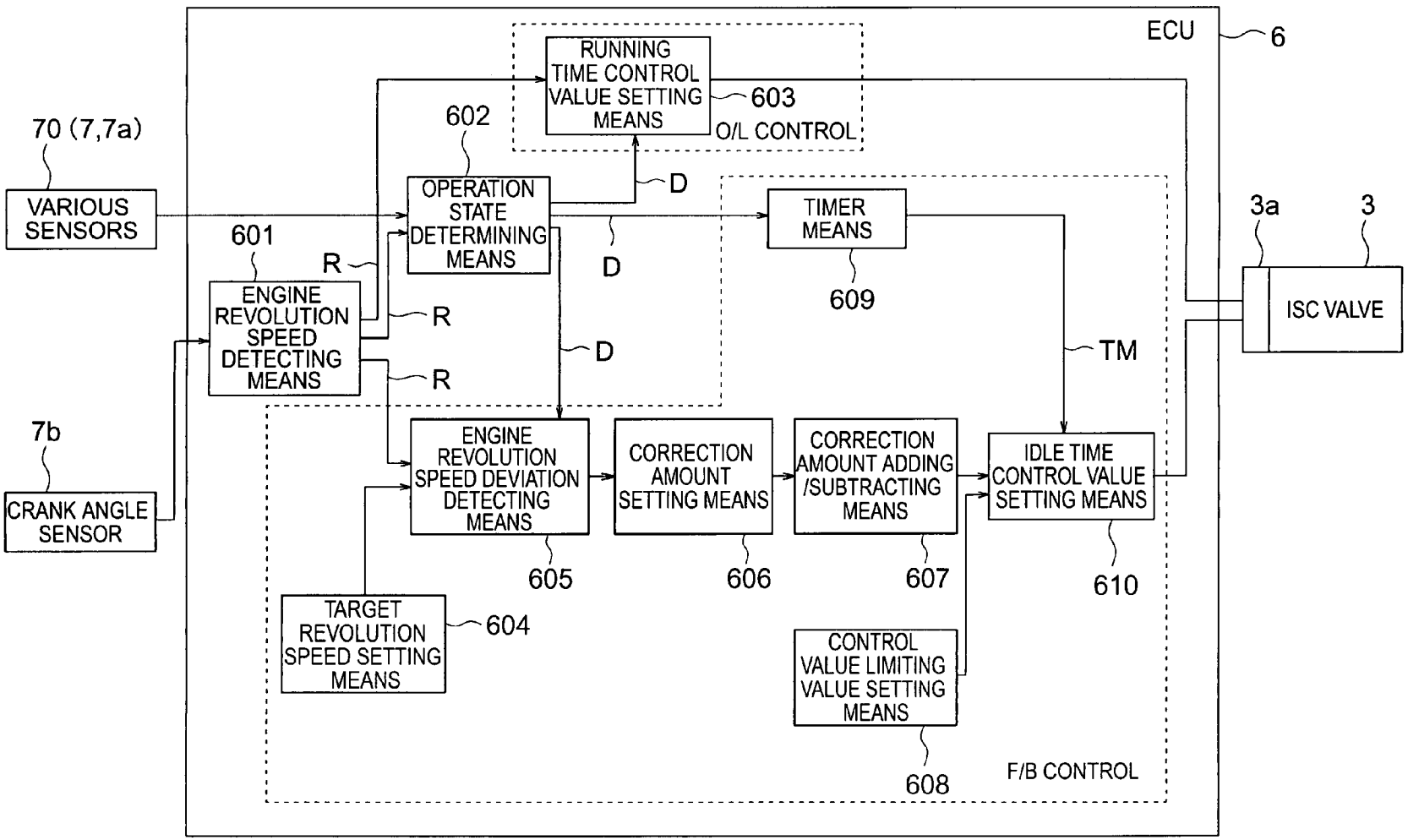
FIG. 2 is a functional block diagram showing an example of a configuration of an ECU of FIG. 1.

FIG. 2 is a functional block diagram showing an example of a configuration of the ECU of FIG. 1. In FIG. 2, engine revolution speed detecting means 601 detects the engine revolution speed from an output of the crank angle sensor 7*b*. Operation state determining means 602 determines the operation state D indicating whether the engine is in the running state or the idle state from the throttle opening angle obtained from various sensors 70 such as the throttle position detection sensor 7 and the throttle valve opening angle sensor 7*a*, and from the engine revolution speed R obtained from the engine revolution speed detecting means 601.

Figure 3:
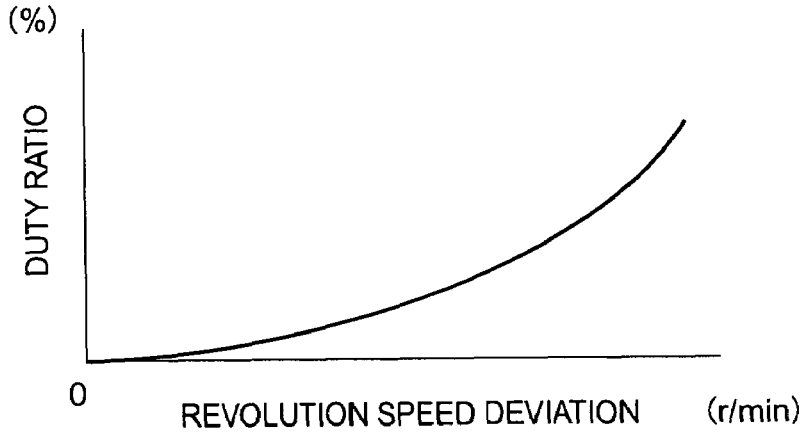
FIG. 3 is a view showing an example of a correction amount map (TKINML) provided in correction amount setting means of FIG. 2.

Engine revolution speed deviation detecting means 605 detects a deviation between the current engine revolution speed R from the engine revolution speed detecting means 601 and a target revolution speed at the idle time, which is preset in target revolution speed setting means 604, when the operation state D from the operation state detecting means 602 is the idle state. Correction amount setting means 606 sets a correction amount of a control value for the ISC valve 3 from the deviation of the engine revolution speed obtained in the engine revolution speed deviation detecting means 605. FIG. 3 shows an example of a correction amount map (TKINML) provided in the correction amount setting means 606, which shows a relationship between the revolution speed deviation and a correction amount of a duty ratio in the case where the ISC valve 3 is composed of, for example, an electromagnetic valve in which a solenoid coil is provided and where the control value for the ISC valve 3 is a control value for the duty ratio for controlling an electric current flowing through the solenoid coil. In general, the correction amount of the duty ratio is increased as the revolution speed deviation is increased. Moreover, in the following, description will be made on the assumption that the ISC valve 3 moves in an opening direction when the control value for the valve is increased and that the ISC valve 3 moves in a closing direction when the control value is reduced. Note that, for the ISC valve, not only the duty solenoid ISC valve as described above but also a step ISC valve can be used. Hence, the control value is a control value for a duty ratio for controlling the opening angle of the ISC valve.

Correction amount adding/subtracting means 607 performs addition/subtraction for a current control value and the correction amount obtained by the correction amount setting means 606. Timer means 609 generates a timer signal TM indicating a predetermined period of time from a point of time when the operation state from the operation state determining means 602 is switched from the running state to the idle state. Idle time control value setting means 610 sets a control value for a control unit 3*a* of the ISC valve 3, which is composed of, for example, the solenoid coil according to the control value from the correction amount adding/subtracting means 607, and limits and sets a lower limit of the control value from the correction amount adding/subtracting means 607 to a lower limit limiting value preset in control value limiting value setting means 608 during a period of time while the timer signal from the timer means 609 is present.

Figure 4:
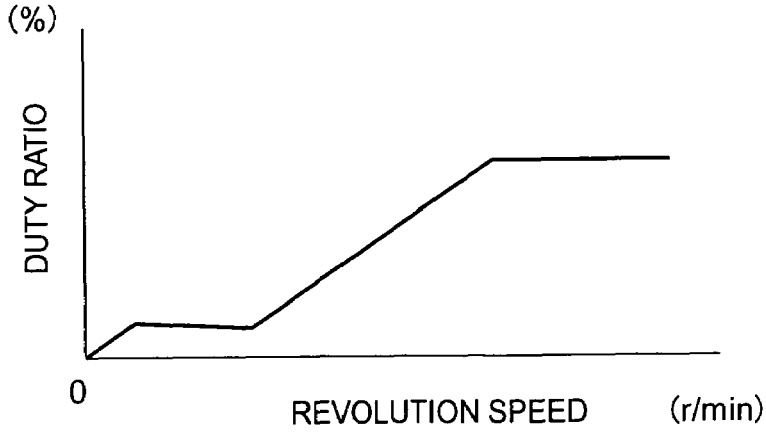
FIG. 4 is a view showing an example of a control value map (TISCDP) at a running time, which is provided in running time control value setting means of FIG. 2.

The running time control value setting means 603 sets a control value for the ISC valve 3 from the engine revolution speed obtained in the engine revolution speed detecting means 601 when the operation state D from the operation state detecting means 602 is the running state. FIG. 4 shows an example of a control valve map (TISCPP) provided in the running time control valve setting means 603, which shows a relationship between the revolution speed and a duty ratio in the case where the ISC valve 3 is composed of, for example, an electromagnetic valve as described above and where the control value for the ISC valve 3 is a control value for the duty ratio for controlling an electric current flowing through the solenoid coil. In general, the duty ratio is increased as the revolution speed is increased.

A running time control value setting unit composed of the running time control value setting means 603 performs open loop (O/L) control. Meanwhile, an idle time control value setting unit composed of the target revolution speed setting means 604, the engine revolution speed deviation detecting means 605, the correction amount setting means 606, the correction amount adding/subtracting means 607, the control value limiting value setting means 608, the timer means 609 and the idle time control value setting means 610, performs feedback (F/B) control. Switching of the control values to the ISC valve 3 from both of these setting units is performed by a signal of the operation state determining means 602, which indicates the operation state D.

Figure 5:
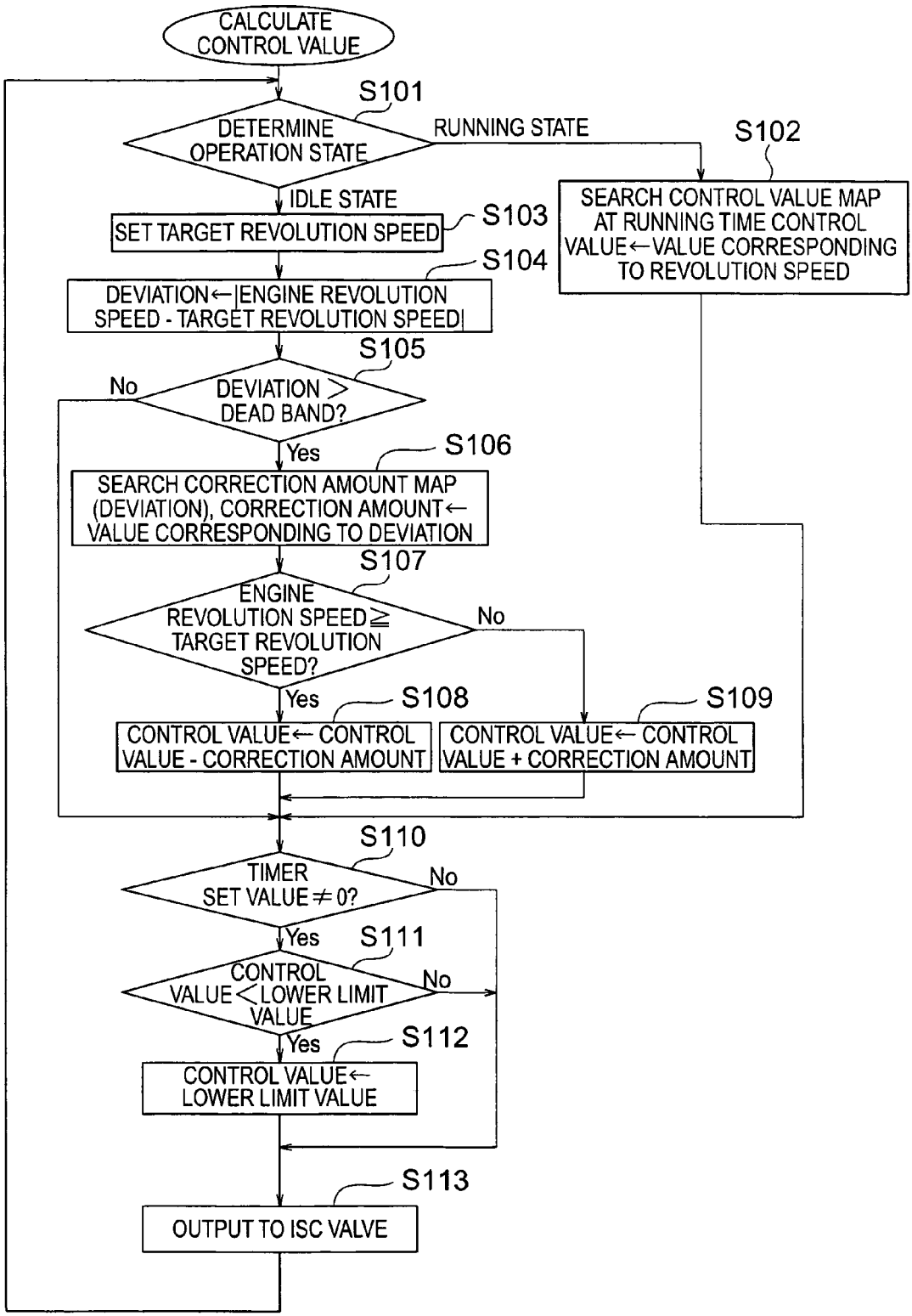
FIG. 5 is a flowchart showing an example of an operation of the ECU of FIG. 1.
Figure 6:
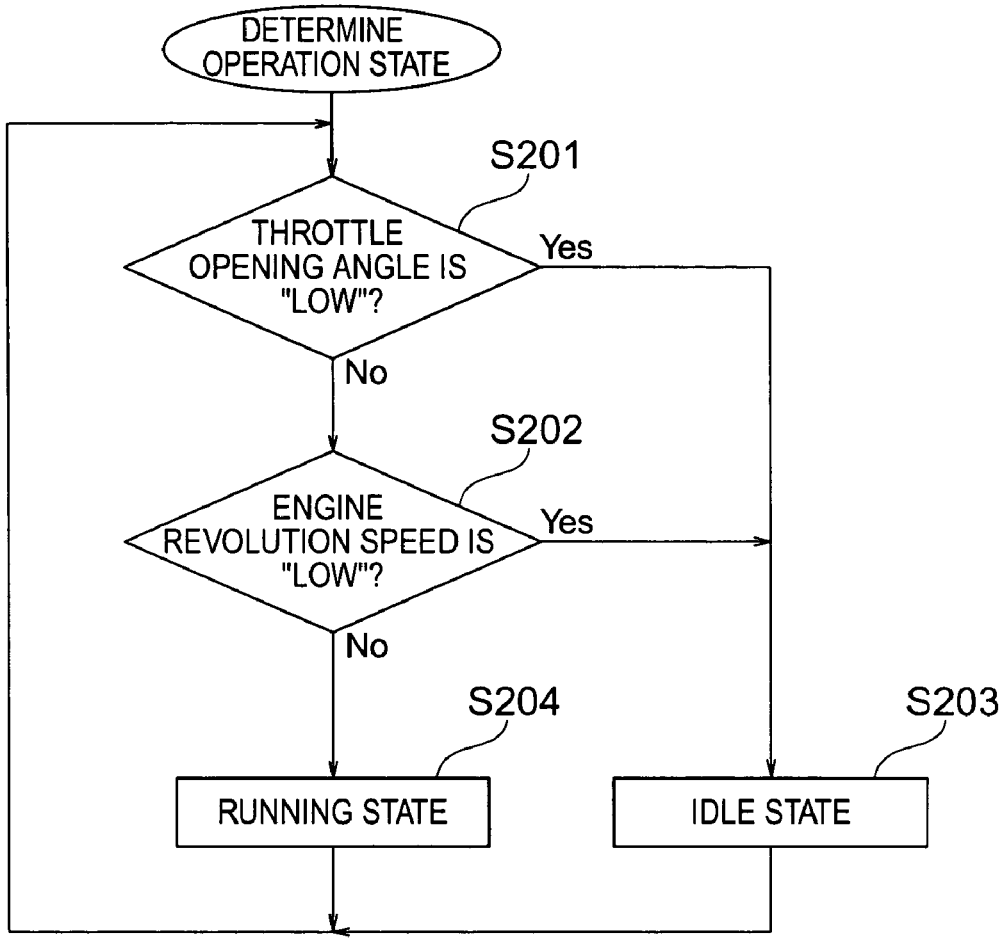
FIG. 6 is a flowchart showing an example of an operation of engine revolution speed detecting means of FIG. 2.
Figure 7:
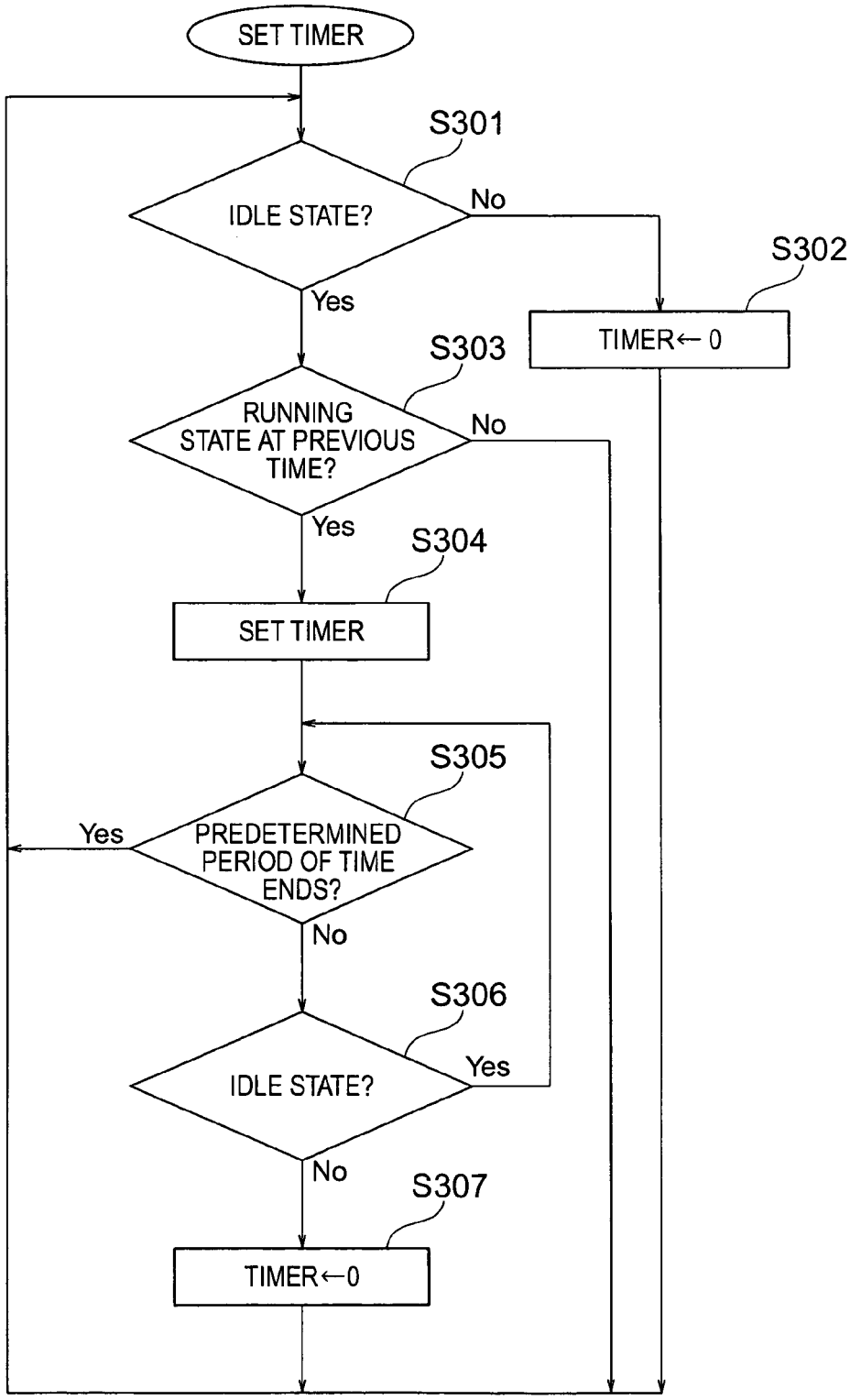
FIG. 7 is a flowchart showing an operation of timer means of FIG. 2.

Next, the operation will be described according to flowcharts of FIGS. 5 to 7. It is determined by the operation state determining means 602 whether the operation state of the engine is the running state or the idle state based on a signal from the above-described throttle position detection sensor 7, which indicates the position of the throttle lever 4, a signal from the above-described throttle valve opening angle sensor 7*a*, which indicates an angular position of the throttle valve 2, and a signal indicating the engine revolution speed, which is obtained from the above-described crank angle sensor 7*b* through the engine revolution speed detecting means 601 (Step S101). For example, as shown in FIG. 6, the operation state is determined to be the idle state (Step S203) when the throttle opening angle is determined to be "low" from the signal of the throttle position detection sensor 7 or the throttle valve opening angle sensor 7*a* (Step S201), or when the engine revolution speed is determined to be "low" from the signal of the crank angle sensor 7*b* (Step S202). Otherwise, the operation state is determined to be the running state (Step S204).

During the running state, for example, the control value map at the running time, which is shown in FIG. 4, is searched by the running time control value setting means 603, and a control value corresponding to the revolution speed is set for the ISC valve 3 and outputted (Steps S102 and S113). Moreover, timer setting is performed in the timer means 609. For example, as shown in FIG. 7, when the operation state is not the idle state but the running state, the timer is set at "0" and does not operate (Steps S301 and S302). When the operation state is determined to be shifted from the running state to the idle state (Steps S301 and S303), the timer setting is performed (Step S304), and the timer signal TM is outputted during the period of time from the point of time when the operation state is switched from the running state to the idle state. When the operation state returns to the running state within this predetermined period of time, the timer is set at "0", and the timer signal TM is stopped (Steps S305 to S307).

During the idle state, by the engine revolution speed deviation detecting means 605, the deviation between the target revolution speed during the idle time, which is preset in the target revolution speed setting means 604, and the current engine revolution speed from the engine revolution speed detecting means 601 is detected. When the deviation exceeds a predetermined dead band, this deviation is outputted (Steps S103 to S105). In the correction amount setting means 606, for example, the correction amount map shown in FIG. 3 is searched, and the correction amount of the control value for the ISC valve 3 is set based on the deviation detected by the engine revolution speed deviation detecting means 605 (Step S106). Then, in the correction amount adding/subtracting means 607, the addition/subtraction for the current control value and the correction amount is performed. Specifically, when the engine revolution speed is equal to or more than the target revolution speed, the correction amount is subtracted from the current control value, and the obtained result is set as a new control value, and when the engine revolution speed is smaller than the target revolution speed, the correction amount is added to the current control value, and the obtained result is set as the new control value (Steps S107 to S109).

Then, by the idle time control value setting means 610, the control value for the control unit 3*a* of the ISC valve 3, which is composed of, for example, the solenoid coil, is set according to the control value from the correction amount adding/subtracting means 607, and is then outputted. During a period of time while the operation state is determined to be shifted from the running state to the idle state, a timer set value of the timer means 609 is not "0", and the timer signal TM is outputted, when the control value is smaller than the lower limit value (lower limit limiting value) preset in the control value limiting value setting means 608, the control value is set at this lower limit value, which is set as the control value for the ISC valve 3, and is then outputted (Steps S110 to S113).

Figure 8A:
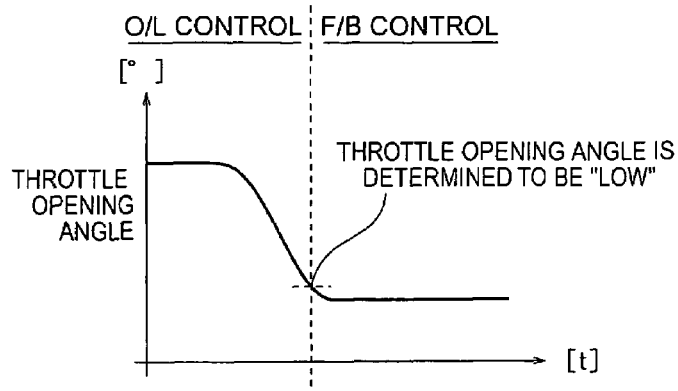
FIG. 8A PRIOR ART
FIGS. 8A to 8C are views for explaining operation characteristics by control of a conventional control apparatus.
Figure 8B:
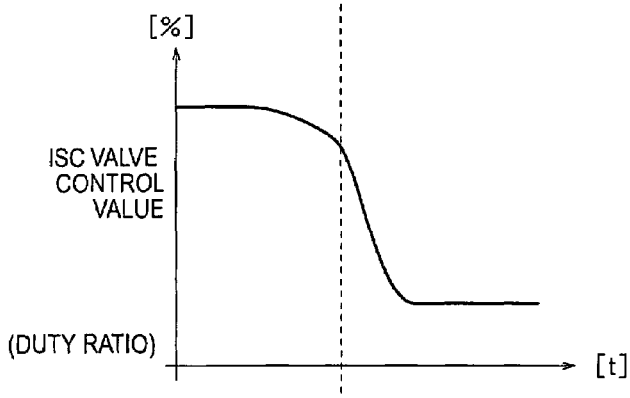
FIG. 8B PRIOR ART
Figure 8C:
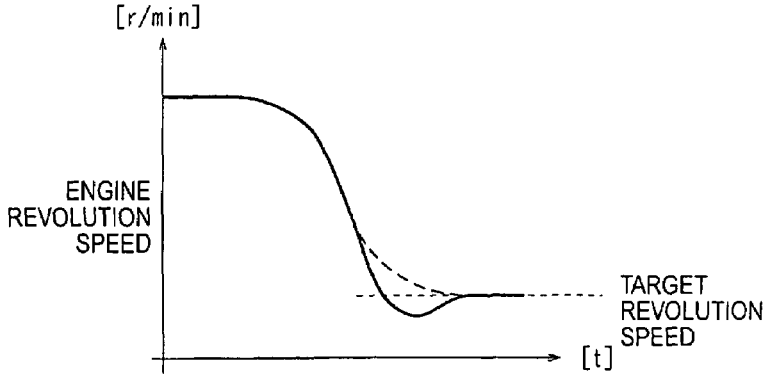
FIG. 8C PRIOR ART
Figure 9A:
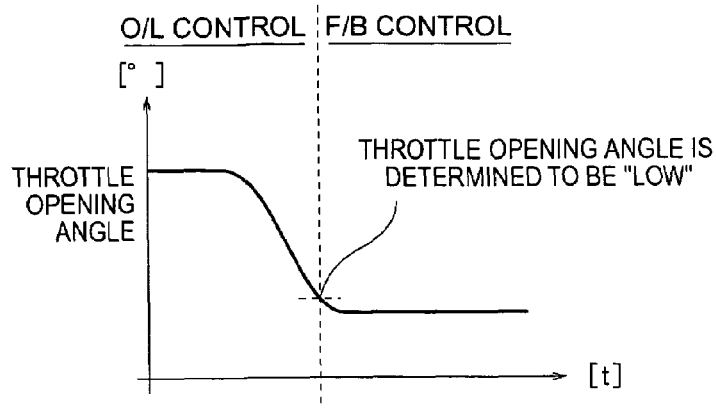
FIGS. 9A to 9C are views for explaining operation characteristics by control of the control apparatus according to the present invention.
Figure 9B:
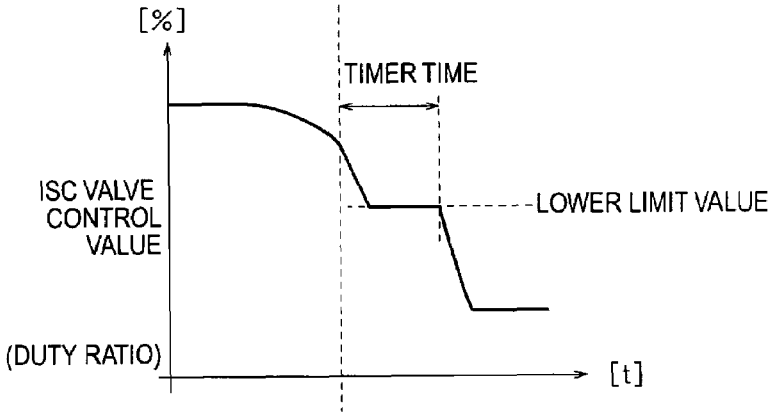
Figure 9C:
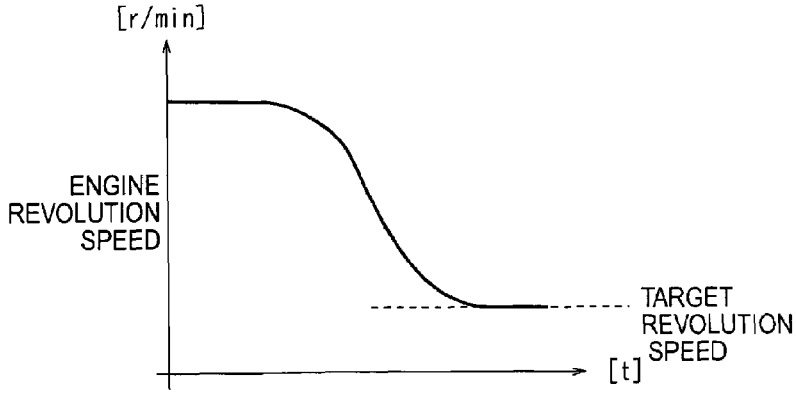

FIGS. 8A to 8C show operation characteristics in the case of control by a conventional control apparatus in which the lower limit value as described above is not provided when the operation state is shifted from the running state to the idle state. FIGS. 9A to 9C show operation characteristics in the case of control by the control apparatus of the present invention, in which the lower limit value as described above is provided in such a shifted state. FIGS. 8A and 9A show the throttle opening angles, FIGS. 8B and 9B show the ISC valve control values (for example, duty ratios), and FIGS. 8C and 9C show the engine revolution speeds. In the case of the conventional control apparatus shown in FIGS. 8A to 8C, it is understood that the engine revolution speed falls to the target revolution speed or less because the ISC valve control value is radically reduced when the throttle opening angle is determined to be "low" and the shift from the running state to the idle state is detected. Depending on cases, it is possible that the engine completely stops (the engine revolution speed reaches "0"). On the other hand, in the case of the control apparatus according to the present invention, which is shown in FIGS. 9A to 9C, the control is performed while the lower limit value is being provided for the ISC control value shown in FIG. 9B during a period of timer time, and accordingly, the engine revolution speed does not fall to the target revolution speed or less. Specifically, in the present invention, even when the throttle is rapidly closed from the running time when the engine revolution speed is high to shift the operation state to the idle state, an intake flow can be prevented from radically falling by providing the lower limit value to the control value for the ISC valve control value during the predetermined period of time. Thus, the A/F does not turn to the over-rich state, and accordingly, abnormal lowering of the revolution speed of the engine can be prevented.

Note that ones for determining the operation state in the operation state determining means 602 are not limited to the above-described ones. The operation state can be obtained also from single signals from the various sensors such as the throttle position detection sensor 7 and the throttle valve opening angle sensor 7*a* or from a single signal of the engine revolution speed obtained from the crank angle sensor 7*b* through the engine revolution speed detecting means 601.

What is claimed is:

1. An internal combustion engine control apparatus that performs open/close control of an ISC valve provided in a bypass pipe to adjust a quantity of air passing through the bypass pipe, the bypass pipe being provided secondarily to an air intake pipe for supplying air to an engine so as to connect portions before and behind a throttle valve, the apparatus comprising:

an operation state determining section for determining whether the engine is in a running state or an idle state according to a signal from an external sensor;

an engine revolution speed detecting section for detecting revolution speed of the engine according to a signal from another external sensor;

a running time control value setting unit which sets an open/close control value for the ISC valve such that the control value increases and the valve opens as the revolution speed of the engine increases, while the engine is in the running state; and an idle time control value setting unit which sets the open/close control value for the ISC valve such that the engine reaches a preset target revolution speed while the engine is in the idle state, and provides a lower limit value to the open/close control value during a predetermined period of time after the engine is switched from the running state to the idle state and sets the control value not to be smaller than the lower limit value, wherein said idle time control value setting unit comprises:

an engine revolution speed deviation detecting section for obtaining a deviation between a current engine revolution speed from said engine revolution speed detecting section and the target revolution speed;

a correction amount setting section for setting a correction amount of the open/close control value for the ISC valve based on a correction amount map preset from the deviation;

a correction amount adding/subtracting section for adding/subtracting the correction amount to/from a current control value;

a timer section for generating a timer signal indicating a predetermined period of time after the engine is switched from the running state to the idle state according to a determination of said operation state determining section; and an idle time control value setting section for setting the control value for the ISC valve according to a control value from said correction amount adding/subtracting section, and limiting and setting a lower limit of the control value from said correction amount adding/subtracting section to a preset lower limit limiting value during a period of time while the timer signal is present.

2. The internal combustion engine control apparatus according to claim 1, wherein said running time control value setting unit comprises running time control value setting section for setting, during the running state, the open/close control value for the ISC valve at a control value corresponding to revolution speed of the engine based on a present running time control value map.

3. The internal combustion engine control apparatus according to claim 1, wherein said operation state determining section determines an operation state of the engine from a throttle opening angle based on a signal from one of throttle position detection sensor of a throttle lever for operating the throttle valve and a throttle valve opening angle sensor of the throttle valve, and from revolution speed of the engine based on a signal from a crank angle sensor, and said revolution speed detecting section detects the revolution speed of the engine from the signal from the crank angle sensor.

4. The internal combustion engine control apparatus according to claim 1, wherein the ISC valve is composed of an electromagnetic valve in which a solenoid coil is provided, and the control value is a control value for a duty ratio for controlling an opening angle of the ISC valve.

5. An internal combustion engine control apparatus comprising:

an idle time control value setting unit, wherein said idle time control value setting unit comprises:

an engine revolution speed deviation detecting section for obtaining a deviation between a current engine revolution speed and a target revolution speed;

a correction amount setting section for setting a correction amount of an open/close control value for an ISC valve based on a correction amount map preset from the deviation;

a correction amount adding and subtracting section for adding or subtracting the correction amount from a current control value;

a timer section for generating a timer signal indicating a predetermined period of time after the engine is switched from a running state to an idle state; and an idle time control value setting section for setting the control value for the ISC valve according to a control value from said correction amount adding and subtracting section, and limiting and setting a lower limit of the control value to a preset lower limit limiting value during a period of time while the timer signal is present.

* * * * *